US010464086B2

(12) United States Patent
Schoeps et al.

(10) Patent No.: US 10,464,086 B2
(45) Date of Patent: Nov. 5, 2019

(54) CARTRIDGE HOLDER, MULTICHAMBER CARTRIDGES AND METERING AND MIXING DEVICES WHICH COMPRISE THESE

(71) Applicant: BASF Coatings GmbH, Muenster (DE)

(72) Inventors: Sibylle Schoeps, Muenster (DE); Thomas Krueger, Muenster (DE); Joachim Vosskuhl, Luedinghausen (DE); Roland Andreas Meisner, Senden (DE); Ernst Schneider, Waldbrunn (DE)

(73) Assignee: BASF Coatings GmbH, Muenster (DE)

( * ) Notice: Subject to any disclaimer, the term of this patent is extended or adjusted under 35 U.S.C. 154(b) by 251 days.

(21) Appl. No.: 15/501,384

(22) PCT Filed: Jul. 6, 2015

(86) PCT No.: PCT/EP2015/065322
§ 371 (c)(1),
(2) Date: Feb. 2, 2017

(87) PCT Pub. No.: WO2016/020129
PCT Pub. Date: Feb. 11, 2016

(65) Prior Publication Data

US 2018/0221898 A1 Aug. 9, 2018

(30) Foreign Application Priority Data

Aug. 5, 2014 (EP) ..... 14179860

(51) Int. Cl.
*B05B 7/04* (2006.01)
*B01F 5/06* (2006.01)
(Continued)

(52) U.S. Cl.
CPC ..... *B05B 7/0408* (2013.01); *B01F 5/061* (2013.01); *B01F 13/0023* (2013.01);
(Continued)

(58) Field of Classification Search
None
See application file for complete search history.

(56) References Cited

U.S. PATENT DOCUMENTS 5,260,101 A 11/1993 Larson et al.
6,769,574 B1 * 8/2004 Keller ..... B05C 17/00509 222/137
(Continued)

FOREIGN PATENT DOCUMENTS

EP 1 602 415 A1 12/2005
GB 2082686 A * 3/1982 ..... B05C 17/00553
(Continued)

OTHER PUBLICATIONS

International Preliminary Report on Patentability and Written Opinion dated Feb. 16, 2017 in PCT/EP2015/065322 (with English translation).
(Continued)

*Primary Examiner* — Michael P. Rodriguez
(74) *Attorney, Agent, or Firm* — Oblon, McClelland, Maier & Neustadt, L.L.P.

(57) ABSTRACT

A metering and mixing device contains a multichamber cartridge and a cartridge holder having a reception container for the multichamber cartridge and a compressed air connection and a connection for an application device. The reception container has an internal tube arranged coaxially to the walls of the cartridge holder and equipped with static mixing elements. The multichamber cartridge contains an upper portion having a directional valve, a middle portion configured as a tubular empty space surrounded by at least
(Continued)

Figure 1A:
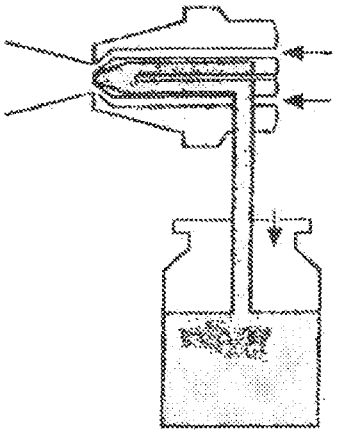
Figure 1A (Prior Art)

two chambers arranged tubularly in the direction of the longitudinal axis of the cartridge, and a lower portion having a piston for each chamber. The multichamber cartridge is arranged in the cartridge holder such that the inner wall of the inner tube of the multichamber cartridge bears, leak-tight, against the outer wall of the tube of the cartridge holder.

9 Claims, 4 Drawing Sheets

(51) Int. Cl.

| | |
|---|---|
| ***B01F 13/00*** | (2006.01) |
| ***B01F 15/00*** | (2006.01) |
| ***B01F 15/02*** | (2006.01) |
| ***B05B 7/24*** | (2006.01) |
| ***B05C 17/005*** | (2006.01) |
| *B05C 17/015* | (2006.01) |

(52) U.S. Cl.
CPC ..... *B01F 15/0087* (2013.01); *B01F 15/0224* (2013.01); *B01F 15/0237* (2013.01); *B05B 7/241* (2013.01); *B05B 7/2437* (2013.01); *B05B 7/2472* (2013.01); *B05C 17/00559* (2013.01); *B01F 2215/005* (2013.01); *B05B 7/2478* (2013.01); *B05C 17/015* (2013.01)

(56) References Cited

U.S. PATENT DOCUMENTS

| | | | |
|---|---|---|---|
| 2008/0195082 | A1 | 8/2008 | Pauser et al. |
| 2010/0098870 | A1 | 4/2010 | Staunton et al. |
| 2013/0001317 | A1 | 1/2013 | Staunton et al. |

FOREIGN PATENT DOCUMENTS

| | | | |
|---|---|---|---|
| JP | 2010-227853 | A | 10/2010 |
| WO | 93/13872 | A1 | 7/1993 |
| WO | 2010/044864 | A1 | 4/2010 |

OTHER PUBLICATIONS

International Search Report dated Sep. 15, 2015 in PCT/EP15/065322 Filed Jul. 6, 2015.

* cited by examiner

CARTRIDGE HOLDER, MULTICHAMBER CARTRIDGES AND METERING AND MIXING DEVICES WHICH COMPRISE THESE

This application is a National Stage of PCT/EP2015/065322, which was filed on Jul. 6, 2015. This application is based upon and claims the benefit of priority to European Application No. 14179860.3, which was filed on Aug. 5, 2014.

The present invention relates to a cartridge holder (1), to multichamber cartridges (2) and to metering and mixing devices which comprise these. The invention relates, further, to a method for the conveyance, metering, mixing and/or application of multicomponent systems, using the metering and mixing devices according to the invention.

Multicomponent systems in the context of the present invention are those systems, the individual components of which are stored separately before application and are mixed with one another in the required quantity ratios only immediately before application. Typical multicomponent systems are, for example, coating media cross-linking at room temperature, such as, for example, lacquers, but also many sealants or adhesives. In the context of the present invention, however, those systems are also considered to be multicomponent systems, the individual components of which do not react chemically with one another, but in which changes to physical properties occur after the intermixing of the components. These may be, for example, viscosity increases after the intermixing of two low-viscosity components, without a chemical reaction having to take place.

Various mixing devices which are designed differently for the respective intended uses are therefore known from the prior art. Thus, mixing devices, such as those employed in painting methods, in particular spray painting methods, often differ greatly from those which are used for adhesives and sealing compounds, such as are offered, for example, in many home improvement and do-it-yourself stores. In these, the material is discharged from the cartridge by means of plungers, that is to say positively displaceable pistons. Since the mixing devices of the present invention can be employed universally, the prior art for both the sector of spray painting methods and that of adhesive and sealing compound application are outlined below.

Spray painting methods, for example without electrostatic paint charging, are in widespread use in industrial and craft paintshops. The methods are distinguished from other painting methods, above all, in that they can be used manually, have high flexibility in terms of the shape, size and materials of the articles to be painted and with regard to paint selection and change of paint, are mobile in use and entail relatively low investment costs (H. Kittel, "*Lehrbuch der Lacke und Beschichtungen*" ["Manual of Paints and Coatings"], second edition, volume 9, pp. 26-40; S. Hirzel Verlag Stuttgart Leipzig, 2004).

Spray painting methods can be divided essentially into compressed air spraying in a high pressure or low pressure method, on the one hand, and airless spraying, with or without aerosystems.

The first spray painting method developed was pneumatic atomization or compressed air spraying at around 1900. Even today, compressed air atomization is employed most often in industry and crafts. In high pressure spraying, also designated as conventional spraying or pneumatic spraying, work is mostly carried out with an air pressure of about 2 to 7 bar, whereas in low pressure spraying, also designated as HVLP spraying ("High Volume, Low Pressure" spraying or spraying with a high spray volume flow and low pressure), work is mostly carried out at an air pressure of 0.2 to 0.7 bar (H. Kittel, ibid).

At the atomizer head, the compressed air flows out of an annular orifice which is formed by a central bore in the air cap and in the paint nozzle arranged therein. Further air jets from various air cap bores serve for regulating the jet shape and for assisting atomization. The compressed air flowing out at high velocity gives rise directly at the paint nozzle mouth to a vacuum zone which, by its suction action, assists the outflow of paint, above all in the case of the pressureless paint feed from what is known as a suction bowl (H. Kittel, ibid).

In addition to the conveyance of the paint material out of a suction bowl, there is also the possibility of feeding the paint material, according to quantity demand and viscosity, to the spray gun nozzle by means of conveying systems, such as flow bowls, pressure vessels or circulation systems (FIGS. 1A-D).

FIG. 1A illustrates paint feed by means of a suction bowl system, and, as illustrated above, this takes place by the suction action of the spray air. Typical bowl contents are volumes up to about one liter.

Figure 1B:
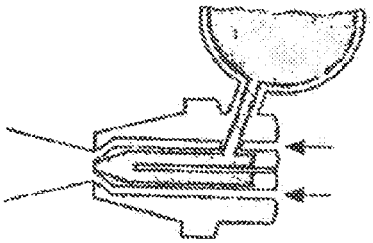
Figure 1B (Prior Art)
Figure 1C:
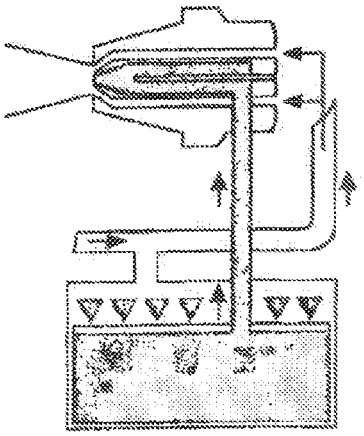
Figure 1C (Prior Art)
Figure 1D:
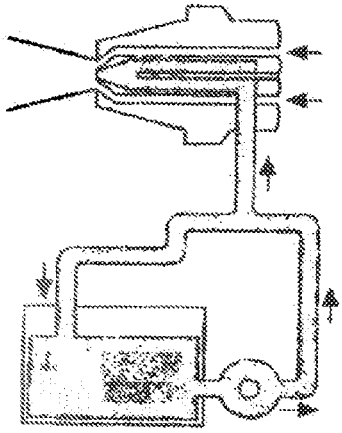
Figure 1D (Prior Art)

FIG. 1B illustrates a flow bowl system in which the paint feed takes place both by the suction action of the spray air and by the assistance of the paint gradient pressure. In this paint conveying system, too, bowl volumes of about one liter are usually not exceeded. The pressure system (FIG. 1C) and the circulation system (FIG. 1D) are likewise known as paint conveying systems. In the pressure system, the paint feed takes place from a pressure tank by the assistance of a pressure of 0.5 to 4 bar (conventional tank content 1 to 250 liters). In the circulation system, paint is conveyed out of a pressureless container and back into this by means of piston or turbine pumps via a ring line. The necessary ring line pressure is set via a pressure holding valve (return check valve). Circulation systems are expediently used typically only in the case of a daily consumption of more than 100 liters of paint (H. Kittel, ibid).

Two-component coating media (2C coating media) are predominantly processed by spray methods because of their limited processing time (potlife). In this case, the metering of stock paint and hardener is the central problem. Where small series and individual parts are concerned, as also, in particular, in the repair painting sector, for example the car repair painting sector, the 2C material is usually mixed manually in the stipulated ratio and sprayed in the same way as a single-component material. In practice, this means that both the metering and the mixing of the components take place before a flow bowl or suction bowl is filled or in the flow bowl or suction bowl itself, and therefore the quality and homogeneity of the mix also depend greatly on the manual abilities of the paint worker. Unconsumed material has to be discarded after the potlife has expired. On the other hand, it is desirable for the paint film to have a rapid drying and hardening behavior, and therefore hardening catalysts are often incorporated into the stock paint and/or hardener of the 2C or multicomponent mix.

It is therefore precisely when 2C or multicomponent coating media are used that it is desirable to have a long processing time or potlife, but at the same time improved drying and the rapid development of hardening of the sprayed-on paint film.

In order to obtain the best possible appearance of the hardened paint film and also reproducible qualities, it is absolutely necessary to produce compositions of stock paint and hardener which are as homogeneous as possible and have a uniformly high quality and which have constant properties over the entire period of time of application. This is not always the case precisely where premixed 2C systems are concerned, for example when a short potlife means that the material sprayed first has a low viscosity because a reaction of the constituents has not yet proceeded, while the material residues sprayed later already contain partially viscosity-increasing crosslinking products.

In the manufacture of large quantities and in the case of short potlives and high quality requirements, highly specialized metering and mixing plants are used in the industry in order to maintain tolerance limits of metering accuracy of +/−5% of the hardener volume in relation to the stock paint quantity. Further developments are aimed at pulsation-free metering and low plant wear, for example by the use of diaphragm-type metering devices. Paint conveying systems with pressure-controlled gear pumps are also known. In multicomponent systems, the delivery rates of the individual gear pumps are coordinated with one another. Static or dynamic systems with driven mixing assemblies are used for mixing. In the case of very short potlives, special guns are also employed, in which stock paint and hardener are discharged from separate nozzles and the droplets which occur are intermixed in the spray jet (H. Kittel, ibid).

However, it is precisely in small-scale paintshops that there is a demand for markedly less complicated conveying, metering and mixing devices. In particular, it should not be necessary to employ the abovementioned special guns or highly specialized metering and mixing assemblies. The simplicity of use of suction bowls or flow bowls should be preserved. Conveyance, metering and mixing should take place solely at the action of pressure. In addition, an external drive for conveyance, metering or mixing should not be required. In particular, there should be no need for a drive by pumps and the like. Nevertheless, a processability which is almost independent of the potlife should still be ensured, at the same time with homogeneous intermixing of the components, before these reach the nozzle of the spray gun, preferably the spray gun itself, or of another application device. The paint films obtained should have good drying and a rapid development of hardness and lead to hardened films with a good appearance.

WO 93/13872 A1 describes a method for applying a multicomponent repair paint coating composition, in which at least two paint components are kept in reserve in separate containers and at least one component is fed under pressure to a kinetic metering plant which comprises two double-acting cylinders attached to pistons and having cylinder rods. The metered components are fed to a mixer which issues into a paint spray gun. The set-up of the metering device is somewhat complex.

WO 2013/104771 A1 discloses a device for the conveyance, metering and mixing of liquid paint components, comprising a paint feed device which comprises two or more paint reservoirs, in each case with at least one outlet orifice for various paint components to be mixed with one another; or comprises one paint reservoir which comprises two or more chambers for various paint components to be mixed with one another, each chamber possessing at least one outlet orifice. The device comprises, furthermore, a metering device which follows the paint feed device and which possesses a number of inlet orifices for the paint components which corresponds to the number of outlet orifices of the paint reservoirs or of the paint reservoir, the metering device being configured such that the volume flows, entering via the inlet orifices, of the paint components to be mixed with one another are forcibly conveyed separately from one another via rotating conveying arrangements serving as metering assemblies, and the conveying arrangements being connected to one another such that their rotational speeds are in fixed ratios to one another, and the metering device having separate outflow orifices for the then metered volume flows of the paint components. Furthermore, the device has a static mixing device which follows the metering device and which possesses a number of inflow orifices for the metered volume flows which corresponds to the number of outflow orifices of the metering device, and the exit of which is designed such that it can be connected to a paint spray gun.

A simple multichamber cartridge for the intermixing and application of multicomponent adhesives, having at least two concentrically arranged chambers, is described in GB 2 276 365 A.

DE 30 31 798 A1 likewise discloses a pressing-out device for multicomponent compounds, in particular multicomponent adhesive, sealing or filler compounds, having containers which are arranged next to one another and which are separated from one another by partitions running parallel to the pressing device.

Each container possesses a pressure piece assigned to it, the pressure pieces being connected to one another via a web having a cutting edge which, during pressing out, cuts through the partitions of the containers. The containers may in this case be arranged coaxially to one another, and the connection of the pressure pieces may take place by means of a web which is implemented as a piston rod and which may be actuated, for example, via a gas column. Intermixing of the components takes place in a chamber which as a tip follows the two containers in the pressing direction.

The metering gun described in EP 2 353 733 A1 makes use of a similar set-up, but in this case the cutting edges cut open the intermediate wall of the containers of the coaxial cartridge helically. According to EP 2 353 733 A1, the pressing-out device according to DE 30 31 798 A1 has the disadvantage that the cut-open partition could prevent the piston from being pressed down further, which is to be avoided by cutting open helically.

In US 2004/0129122, an attempt was made to solve the problem addressed in EP 2 353 733 A1 in another way, to be precise by pressing the cut-off partition onto the inner wall of the outer tube via a deflecting plate.

U.S. Pat. No. 4,493,436 describes a device similar to the two devices mentioned above, but with chambers which are not arranged coaxially.

British patent application GB 2 246 172 discloses a complex set-up of a two-chamber cartridge, in which a concertina-like set-up of a chamber is implemented and a static mixer follows the chambers in the pressing direction.

DE 10 2010 019 220 A1 discloses a cartridge system with connected conveying bodies, in particular for mixing and applying a medical cement. The conveying pistons can be operated by gas pressure. However, a central mixing space, illustrated in the figures of this publication, is closed on one side and can serve only to a limited extent, if at all, for the intermixing of the components. It in no way replaces the necessary intermixing in the region of the outlet orifice of the cartridge or sprayer. Moreover, because of the necessary travel of the conveying pistons, the material chambers are very small, and therefore there is a poor utilization of the overall volume of the device by the cement components.

What all the devices mentioned above have in common is that they have mixing sections which follow the pressing-out direction and which are designed as simple mixing chambers or simple static mixers. All the mixing sections either are very short and unsuitable for demanding mixing operations, such as the mixing of two-component or multicomponent paints, in particular are unsuitable for the automobile paint sector, or metering and mixing are organized in a complex way. It is precisely here where absolutely homogeneous intermixing is a basic precondition for an outstanding appearance. However, the provision of long mixing sections would considerably increase the set-up of the cartridges of the prior art, and because of this they are unwieldy when operated manually.

There is therefore, particularly for demanding mixing operations, a need for metering and mixing devices which ensure accurate metering of the components to be intermixed, in particular even in the intermixing of components of different viscosities. Moreover, the metering and mixing devices should have a small set-up height, with as long a mixing section as possible. The operation of the metering and mixing device should as far as possible be possible without movable structural parts, while the conveyance of the materials to be intermixed should take place by means of compressed gases, in particular compressed air. Intermixing should be superior to the mixing variants known from the prior art, without the mixing section leading to an additional set-up height of the cartridges to be used in the metering and mixing device. Furthermore, the mixing elements of the static mixer of the metering and mixing device should be easy to clean, if possible even while the components remain in the cartridge of the metering and mixing device. However, components which are not used up completely should also be removable from the metering and mixing device in a simple way by means of the cartridge for storage purposes.

The abovementioned objects were achieved by the inventors of the present invention in a surprising way by the provision of a metering and mixing device which does not have the disadvantages of the prior art and which conforms to the abovementioned requirements.

Figure 2:
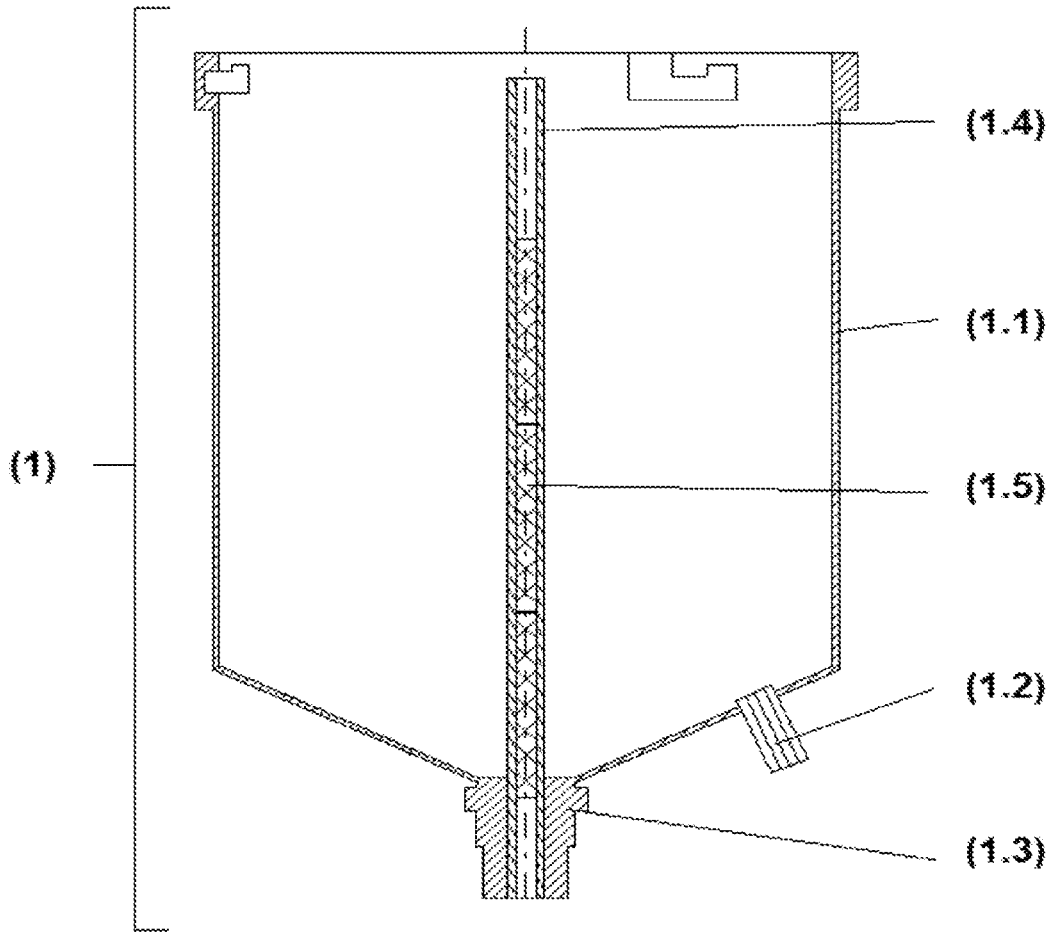
Figure 3:
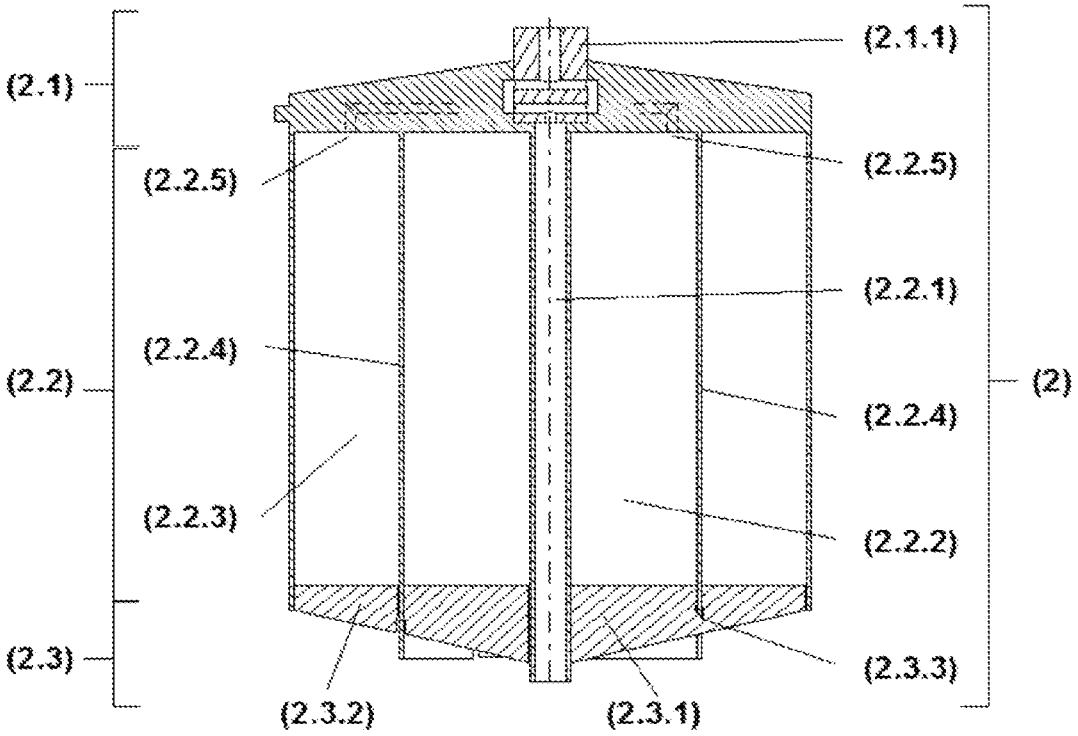
Figure 4:
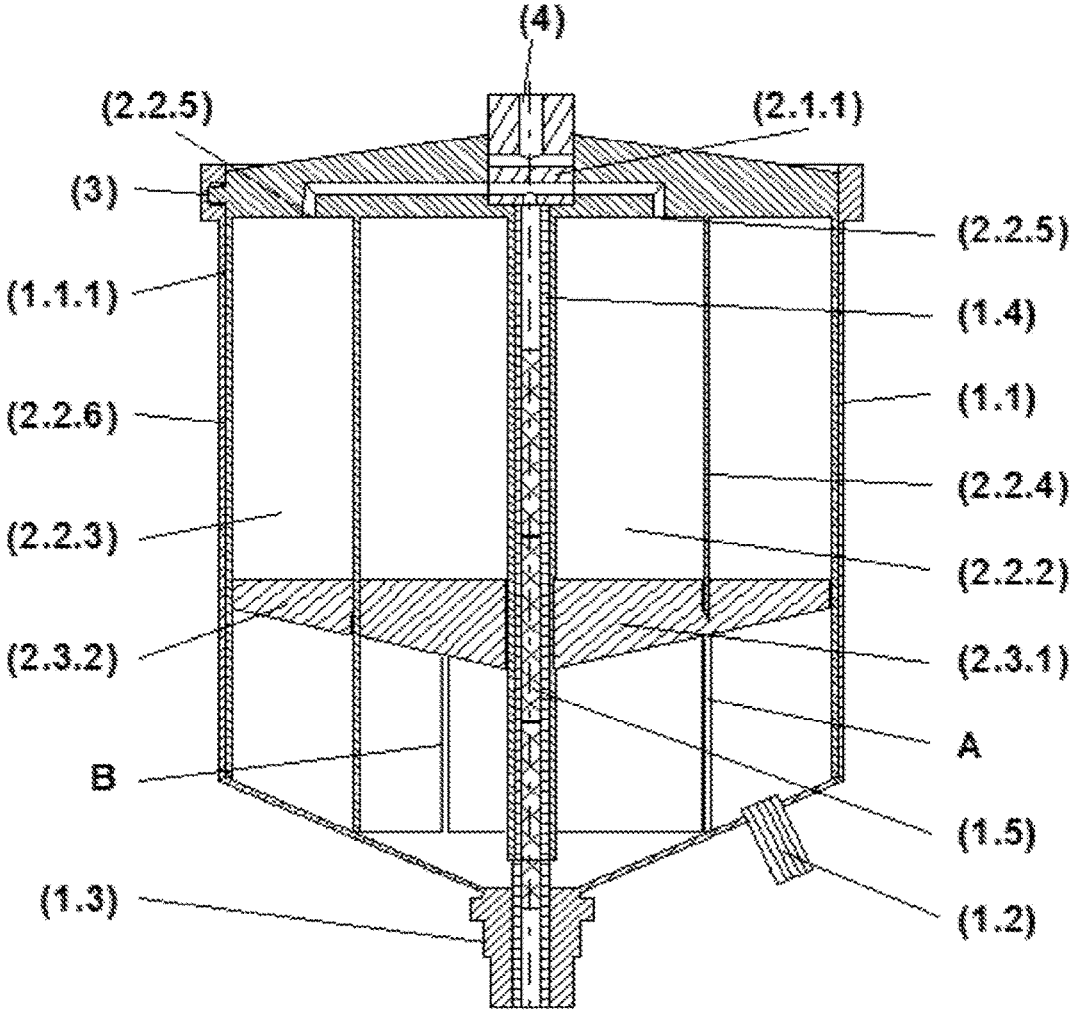

The accompanying FIGS. 1A, 1B, 1C, 1D, 2, 3 and 4 serve for explaining the present invention. In this case, FIGS. 1A, 1B, 1C and 1D relate to the prior art. FIG. 2 shows a cartridge holder according to the invention, FIG. 3 a cartridge according to the invention and FIG. 4 a metering and mixing device according to the invention. In FIGS. 2 to 4, the following reference symbols are used: (1) cartridge holder, (1.1) reception container for multichamber cartridges, (1.1.1) inner wall of the cartridge holder, (1.2) compressed air connection, (1.3) connection for an application device, (1.4) internal tube, (1.5) static mixing elements, (2) multichamber cartridge, (2.1) upper portion of the multichamber cartridge, (2.1.1) directional valve, (2.2) middle portion of the multichamber cartridge, (2.2.1) tubular empty space, (2.2.2) and (2.2.3) chambers, (2.2.4) partition between adjacent chambers, (2.2.5) orifices of the chambers of the middle portion of the multichamber cartridge toward the upper portion of the multichamber cartridge, (2.2.6) outer wall of the middle portion of the multichamber cartridge, (2.3) lower portion of the multichamber cartridge, (2.3.1) and (2.3.2) pistons, (2.3.3) cutting device, (3) bayonet fastening, (4) connection for scavenging media, (A) cut area in the partition of two adjacent chambers, (B) cut in the partition of two adjacent chambers.

The metering and mixing device according to the invention in this case comprises i. a cartridge holder (1), comprising
   (a) a reception container (1.1) for multichamber cartridges (2),
   (b) a compressed air connection (1.2) and a connection (1.3) for an application device,
   (c) the reception container (1.1) having an internal tube (1.4) which is arranged coaxially to the walls of the cartridge holder (1) and which is equipped with static mixing elements (1.5), and ii. a multichamber cartridge (2) for the cartridge holder (1) according to i., said multichamber cartridge comprising the following portions:
   an upper portion (2.1), comprising a directional valve (2.1.1);
   a middle portion (2.2), the center of which is configured in the direction of the longitudinal axis as a tubular empty space (2.2.1), and the tubular empty space (2.2.1) is surrounded by at least two chambers (2.2.2 and 2.2.3), the chambers being arranged in a tubular manner and in the direction of the longitudinal axis of the cartridge, and adjacent chambers being separated from one another by a common partition (2.2.4), and each chamber being connected to the upper portion (2.1) in each case via at least one orifice (2.2.5); and
   a lower portion (2.3) which comprises a piston (2.3.1 and 2.3.2) for each of the chambers, the pistons (2.3.1 and 2.3.2) closing off the chambers (2.2.2 and 2.2.3), leak-tight, from below and being connected to one another via cutting devices (2.3.3), and the cutting devices (2.3.3) being arranged such that they can sever the common partition (2.2.4) of in each case adjacent chambers when the pistons (2.3.1 and 2.3.2) are displaced in the direction of the upper portion (2.1), the multichamber cartridge (2) being arranged in the cartridge holder (1) such that the tubular empty space (2.2.1) of the multichamber cartridge (2) is filled with a form fit by the tube (1.4) in the cartridge holder (1), and the outer wall (2.2.6) of the middle portion (2.2) of the multichamber cartridge (2) bears with a form fit against the inner wall (1.1.1) of the cartridge holder (1).

If it is a question herein of a "tubular chamber", this means that the chamber is shaped in the form of a straight hollow cylinder, the cavity forming the chamber. In the simplest case, the cross-sectional area of the chamber is an annulus, but other cross-sectional area geometries may also be envisaged, such as, for example, segments of annuli. Thus, an annular cross-sectional area may also be subdivided into two or more segments of identical or different size. The partitions of adjacent chambers in this case serve as boundaries of the segments. Of course, almost any other geometries can be implemented, thus, for example, the straight hollow cylinders with a cross-sectional area in the form of an annular segment may also be replaced by individual tubes with a circular cross-sectional area.

A further subject of the invention is a cartridge holder (1), comprising (a) a reception container (1.1) for multichamber cartridges (2), and
(b) a compressed air connection (1.2) and a connection (1.3) for an application device,
(c) the reception container (1.1) having an internal tube (1.4) which is arranged coaxially to the walls of the cartridge holder (1) and which is equipped with static mixing elements (1.5).

The subject of the invention is also a multichamber cartridge (2) for a cartridge holder (1) of the abovementioned type, said multichamber cartridge comprising the following portions:

an upper portion (2.1), comprising a directional valve (2.1.1);
a middle portion (2.2), the center of which is configured in the direction of the longitudinal axis as a tubular empty space (2.2.1), and the tubular empty space (2.2.1) is surrounded by at least two chambers (2.2.2 and 2.2.3), the chambers being arranged in a tubular manner and in the direction of the longitudinal axis of the cartridge, and adjacent chambers being separated from one another by a common partition (2.2.4), and each chamber being connected to the upper portion (2.1) in each case via at least one orifice (2.2.5); and a lower portion (2.3) which comprises a piston (2.3.1 and 2.3.2) for each of the chambers, the pistons (2.3.1 and 2.3.2) closing off the chambers (2.2.2 and 2.2.3), leak-tight, from below and being connected to one another via cutting devices (2.3.3), and the cutting devices (2.3.3) being arranged such that they can sever the common partition (2.2.4) of in each case adjacent chambers when the pistons (2.3.1 and 2.3.2) are displaced in the direction of the upper portion (2.1).

Preferably, the multichamber cartridge (2) is designed as a coaxial cartridge for a cartridge holder (1), as defined above, said multichamber cartridge comprising the following portions:

an upper portion (2.1), comprising a directional valve (2.1.1);

a middle portion (2.2), the center of which is configured in the direction of the longitudinal axis as a tubular empty space (2.2.1), and the tubular empty space (2.2.1) is surrounded by at least two chambers (2.2.2 and 2.2.3), the chambers being arranged in a tubular manner and coaxially in the direction of the longitudinal axis of the cartridge, and adjacent chambers being separated from one another by a common partition (2.2.4), and each chamber being connected to the upper portion (2.1) in each case via at least one orifice (2.2.5); and a lower portion (2.3) which comprises a piston (2.3.1 and 2.3.2) for each of the chambers, the pistons (2.3.1 and 2.3.2) closing off the chambers (2.2.2 and 2.2.3), leak-tight, from below and being connected to one another via cutting devices (2.3.3), and the cutting devices (2.3.3) being arranged such that they can sever the common partition (2.2.4) of in each case adjacent chambers when the pistons (2.3.1 and 2.3.2) are displaced in the direction of the upper portion (2.1).

Such a set-up can be obtained, for example, by coaxial arrangement of three tubes, in this case the inner tube surrounds the tubular empty space (2.2.1). The space between the outer surface of the inner tube and the inner surface of the middle tube forms, closed off in the direction of the lower portion (2.3) by a piston (2.3.1) and closed off in the direction of the upper portion (2.1) by an orifice (2.2.5) to the upper portion (2.1), a first chamber (2.2.2). The space between the outer surface of the middle tube and the inner surface of the outer tube forms, closed off in the direction of the lower portion (2.3) by a piston (2.3.2) and closed off in the direction of the upper portion (2.1) by an orifice (2.2.5) to the upper portion (2.1), a second chamber (2.2.3).

The tubular empty spaces (2.2.1) of the abovementioned cartridges serve for receiving the internal tube (1.4) of the cartridge holder (1). If the tubular empty space (2.2.1) is surrounded by a tube, the latter also extends through the lower portion (2.3) of the cartridge.

In an especial embodiment, the internal tube (1.4) of the cartridge holder may be absent in the cartridge holder (1) and already be integrated into the multichamber cartridge (2). That is to say, in such a case, the cartridge holder (1) does not have to have an internal tube (1.4) and is therefore a customary cartridge holder, since, in this embodiment, the static mixing elements (1.5) are already integrated in the multichamber cartridge (2). This has the advantage that a simple cartridge holder without an internal tube (1.4) can be used.

Such a metering and mixing device likewise according to the invention in this case comprises i. a cartridge holder (1), comprising
   (a) a reception container (1.1) for multichamber cartridges (2), and
   (b) an arranged compressed air connection (1.2) and a connection (1.3) for an application device, and ii. a multichamber cartridge (2) for a cartridge holder (1) according to i., said multichamber cartridge comprising the following portions:
   an upper portion (2.1), comprising a directional valve (2.1.1);
   a middle portion (2.2), the center of which is configured in the direction of the longitudinal axis as a tubular space equipped with static mixing elements (1.5) and is preferably provided at the lower end with a sealing arrangement, and the tubular space is surrounded by at least two chambers (2.2.2 and 2.2.3), the chambers being arranged in a tubular manner and in the direction of the longitudinal axis of the cartridge, and adjacent chambers being separated from one another by a common partition (2.2.4), and each chamber being connected to the upper portion (2.1) in each case via at least one orifice (2.2.5); and
   a lower portion (2.3) which comprises a piston (2.3.1 and 2.3.2) for each of the chambers, the pistons (2.3.1 and 2.3.2) closing off the chambers (2.2.2 and 2.2.3), leak-tight, from below and being connected to one another via cutting devices (2.3.3), and the cutting devices (2.3.3) being arranged such that they can sever the common partition (2.2.4) of in each case adjacent chambers when the pistons (2.3.1 and 2.3.2) are displaced in the direction of the upper portion (2.1), the multichamber cartridge (2) being arranged in the cartridge holder (1) such that the outer wall (2.2.6) of the middle portion (2.2) of the multichamber cartridge (2) bears with a form fit against the inner wall (1.1.1) of the cartridge holder (1).

A multichamber cartridge (2) suitable for this embodiment therefore comprises:

an upper portion (2.1), comprising a directional valve (2.1.1);

a middle portion (2.2), the center of which is configured in the direction of the longitudinal axis as a tubular space equipped with static mixing elements (1.5), and the tubular space is surrounded by at least two chambers (2.2.2 and 2.2.3), the chambers being arranged in a tubular manner and in the direction of the longitudinal axis of the cartridge, and adjacent chambers being separated from one another by a common partition (2.2.4), and each chamber being connected to the upper portion (2.1) in each case via at least one orifice (2.2.5); and a lower portion (2.3) which comprises a piston (2.3.1 and 2.3.2) for each of the chambers, the pistons (2.3.1 and 2.3.2) closing off the chambers (2.2.2 and 2.2.3), leak-tight, from below and being connected to one another via cutting devices (2.3.3), and the cutting devices (2.3.3) being arranged such that they can sever the common partition (2.2.4) of in each case adjacent chambers when the pistons (2.3.1 and 2.3.2) are displaced in the direction of the upper portion (2.1).

A further preferred embodiment of the abovementioned multichamber cartridge (2) with an integrated static mixer is a coaxial cartridge, the latter comprising the following portions:

an upper portion (2.1), comprising a directional valve (2.1.1);

a middle portion (2.2), the center of which is configured in the direction of the longitudinal axis as a tubular space equipped with static mixing elements (1.5), and the tubular space is surrounded by at least two chambers (2.2.2 and 2.2.3), the chambers being arranged in a tubular manner and coaxially in the direction of the longitudinal axis of the cartridge, and adjacent chambers being separated from one another by a common partition (2.2.4), and each chamber being connected to the upper portion (2.1) in each case via at least one orifice (2.2.5); and a lower portion (2.3) which comprises a piston (2.3.1 and 2.3.2) for each of the chambers, the pistons (2.3.1 and 2.3.2) closing off the chambers (2.2.2 and 2.2.3), leak-tight, from below and being connected to one another via cutting devices (2.3.3), and the cutting devices (2.3.3) being arranged such that they can sever the common partition (2.2.4) of in each case adjacent chambers when the pistons (2.3.1 and 2.3.2) are displaced in the direction of the upper portion (2.1).

It is true of all the embodiments of the cartridges that, for use as conveying, metering and mixing units, they contain in the individual chambers preferably different components to be intermixed. In particular, components which, after being intermixed, can react with one another or should be stored separately for other reasons. Thus, for example, stock paints and their hardeners can be stored separately in the chambers of the cartridges, or low-viscosity liquids which build up higher viscosity or thixotropy only after being intermixed. However, differently colored components, such as, for example, a black filler component and a white filler component, can also be intermixed in this way to form a gray mix.

Since the volumes of the chambers are freely selectable during the production of the cartridges, the components to be intermixed can be stored separately from one another in the quantity ratios necessary for later use. In the preferred coaxial cartridges, the volumes of the chambers are fixed via the diameters of the tubes. It is true of all the embodiments that the volume flows of the components, such as, for example, of the stock paint and hardener, are fed separately from one another to the directional valve (2.1.1) of the upper portion (2.1). The directional valve (2.1.1) is especially preferably a 3/2-way valve (2.1.1). The directional valve (2.1.1) or 3/2-way valve (2.1.1) may also, in a preferred embodiment, have a premixing chamber which is integrated in the directional valve (2.1.1) and in which the initially separate volume flows of the components meet one another and can be intermixed. When the directional valve (2.1.1) is in the "metering/mixing" position, that is to say in the working position, the components, which either are present, premixed, in the premixing chamber integrated in the directional valve (2.1.1) or are present, as far as possible unmixed, in the absence of such a premixing chamber, are fed to the actual mixing section. What serves as a mixing section is either the internal tube (1.4) which is located in the cartridge holder (1) and is equipped with static mixing elements (1.5) or the tubular space, equipped with static mixing elements (1.5), of the likewise above-described variant of a multichamber cartridge (2). In both cases, a region free of static mixing elements (1.5) may be present as a premixing section upstream of the first static mixing elements (1.5) located in the mixing section.

The feed of the components to the directional valve (2.1.1) takes place via the pistons (2.3.1 and 2.3.2) which close off the chambers from below. The pistons (2.3.1 and 2.3.2) in this case, driven pneumatically, press the corresponding components out of their chambers into the upper portion (2.1) of the multichamber cartridge (2). In this case, the partition (2.2.4) between the chambers is severed by the cutting device (2.3.3) which connects the pistons (2.3.1 and 2.3.2), as result of which further emptying of the chambers is first possible. In all the embodiments, the cutting device (2.3.3) connects the pistons (2.3.1 and 2.3.2) serving as the bottom of the chambers, thereby also ensuring that the pistons (2.3.1 and 2.3.2), when acted upon by pressure, are moved simultaneously, and therefore, even in the case of components having greatly differing viscosity, the components are pressed out of the chambers in the ratio of the chamber sizes to one another and consequently independently of viscosity. Emptying therefore takes place in the volumes stipulated by the chamber size and consequently with the desired metering. After optional premixing in the premixing chamber, integrated where appropriate in the above-described directional valve (2.1.1), in the upper portion (2.1) of the cartridge, the components are pressed through the internal tube (1.4) of the cartridge holder (1) or, when a cartridge with an integrated static mixer is used, opposite to the pressing-out direction of the separate components out of the chambers by the static mixing elements (1.5) and are in this case intermixed homogeneously.

The components stored in the separate chambers can therefore come into contact with one another either already in a premixing chamber integrated in the directional valve (2.1.1) of the upper portion (2.1) or in a portion, present where appropriate, between the directional valve (2.1.1) and the first static mixing elements (1.5) or upon contact with the static mixing elements (1.5).

In an especial refinement, the static mixing device is composed of a mixing tube with stationary fittings. Preferably, mixer rods, as they are known, can be used. Most especially preferred mixer rods are obtainable, for example, from the company Fluitec Georg AG (Neftenbach, Switzerland) under the designation CSE-X® mixer or by the company Industra GmbH (Heusenstamm, Germany) under the designation "mixing element" with article number 205059 (76-104).

The cartridge holder (1) possesses a compressed air connection (1.2) which is preferably arranged at the bottom of the reception container (1.1), and also a connection (1.3) for an application device. The placement of the compressed air connection (1.2) is such that the compressed air flowing in during operation moves the pistons (2.3.1 and 2.3.2) serving as the bottom of the chamber, so that the components can be pressed out of the chambers.

In all the embodiments of the invention, the cartridge holder (1) can be closed by means of a cover which then fixes the multichamber cartridge (2) in the cartridge holder (1). In such a case, to operate the metering and mixing device according to the invention, a multichamber cartridge (2) according to the invention is inserted into the cartridge holder (1) and the cartridge holder (1) is closed by means of a pressure-tight cover. The type of closure is irrelevant in this case, thus, for example, a screw thread closure may be used or, in an especially preferred embodiment, a bayonet fastening (3), in particular a safety bayonet fastening. The cartridge holder (1) and multichamber cartridge (2) are then adapted to the type of closure of the cover. Thus, if a screw closure is used, the cartridge holder (1) possesses a thread suitable for this purpose or, if a bayonet fastening (3) is used, said cartridge holder is provided with appropriate material stiffening to accommodate the slots, the multichamber cartridge (2) being equipped with webs for the bayonet fastening.

However, it is also possible to operate the metering and mixing devices according to the invention without a cover. The multichamber cartridge (2) is then fixed in the cartridge holder (1) by virtue of the form of the upper portion (2.1) of the cartridge and of the holder, the same types of closure as in the cover variant being implementable.

The cutting device (2.3.3) for severing the wall between two adjacent component chambers (2.2.2 and 2.2.3) is preferably designed as a wedge-shaped gap similar to open scissors. Consequently, upsetting of material where the partitions are cut into can be prevented, at the same time the cutting-in force can be reduced.

Connecting the connection (1.3) at the bottom of the reception container (1.1) of the cartridge holder (1) to an application device presents no problem and can take place by means of all customary connections, preferably by means of a screw thread or quick-action couplings or dovetail connections. It is also possible to integrate static mixing elements (1.5) into the connection (1.3) or to prolong the internal tube (1.4), equipped with static mixing elements (1.5) and located in the cartridge holder (1), through the connection (1.3) or connection region as far as the connected application device.

Any type of application device is suitable, in principle, as an application device. The application devices serve for applying the intermixed components, these preferably being coating media, such as paints, fillers, sealing compounds or adhesives, onto substrates. Thus, for example, sponges, paintbrushes, rollers, doctor blades or nozzles of the most diverse possible types, such as, for example, flat jet nozzles, broad jet nozzles, broad slot nozzles, multiduct (fan) nozzles or circular jet nozzles, in such cases the nozzles being with or without atomizer air, may be used. A most especially preferred application device is afforded by spray guns, preferably those for the spray application of coating medium compositions.

All spray guns which are used during compressed air spraying are suitable, in principle, as spray guns. Connecting the connection (1.3) at the bottom of the reception container (1.1) of the cartridge holder (1) to the spray gun presents no problem and can take place by means of all customary connections, preferably by means of a screw thread or quick-action couplings or dovetail connections. Paint spray guns are obtainable, for example, from the company Sata GmbH & Co. KG (Kornwestheim, Germany) under the designation SATAjet®, as HVLP or RP spray guns.

All the structural parts and materials of the metering and mixing device are selected such that they are designed for the pressures which occur and for their intended function and are as far as possible chemically inert with respect to the components to be intermixed and those which are intermixed. In particular, polypropylenes are employed for the walls of the chambers or of the tubes. Polyethylenes, polycarbonates and/or composite materials are conventionally suitable as pistons (2.3.1 and 2.3.2) and polycarbonate as a material for the cutting device (2.3.3). However, the metering and mixing device and its constituents are not restricted to these materials. Thus, in particular, metals may also be used, for example, for forming the cutting device (2.3.3), or coated materials, for example in order to make it possible to have an inert behavior with respect to components which may be chemically aggressive.

The cleaning of the metering and mixing devices according to the invention can take place in a simple way via the directional valve (2.1.1), in which case the multichamber cartridge (2) can remain in the reception container (1.1) during cleaning. For this purpose, the directional valve (2.1.1) located in the upper portion (2.1) of the multichamber cartridge (2) is moved out of its "metering/mixing" operating position into the "scavenging" cleaning position. In the "metering/mixing" operating position, the components can be pressed out of the chambers into the directional valve (2.1.1), with the scavenging connection (4) at the same time being shut off, whereas, in the "scavenging" cleaning position, the feed of the components out of the component chambers is interrupted and the central mixing duct can be connected to a scavenging connection (4). Scavenging takes place with a scavenging medium, preferably with commercially available solvents and/or water, while, if desired or if necessary, the scavenging medium may contain additional detergents and/or other typical cleaning agent additives. Scavenging may take place with or without air pulses. The scavenging medium should be capable of as far as possible dissolving the components of the multicomponent system and any reaction products. During scavenging, the scavenging medium is conducted through the static mixing device, in order, in particular, to free the static mixing elements (1.5) of the adhering component mix and of reaction products which, where appropriate, are already formed. After cleaning, the multichamber cartridge (2) can easily be removed from the metering and mixing device and stored.

The present invention also relates to a method for the conveyance, metering and mixing of two or more components, preferably paint components, adhesive components or sealant components, especially preferably paint components, which method makes use of the metering and mixing device according to the invention.

The present invention relates, further, to a method for the coating of substrates with 2C or multicomponent coating media, using the metering and mixing device according to the invention in combination with an application device, preferably a paint spray gun. The method according to the invention for coating is especially advantageously carried out purely manually.

In particular, the method according to the invention is suitable for coating using small paint quantities. Preferably, the method is carried out as an HVLP spray method. Most especially preferably, it is employed in car repair painting. The abovementioned method may, however, also be used in the context of OEM first painting, in particular during what is known as assembly repair.

The method according to the invention for the coating of substrates with 2C or multicomponent coating media, using the metering and mixing device according to the invention in combination with an application device, comprises, in an especial refinement, a scavenging step. In this method variant, the application of the 2-component or multicomponent coating medium is interrupted once or more than once, the multichamber cartridge (2) is cleaned during the interruption in application, and, after the cleaning of the multichamber cartridge (2), application is continued with the same multichamber cartridge (2) or with another multichamber cartridge (2) according to the invention. During cleaning, the static mixing device of the metering and mixing device according to the invention is scavenged. In this case, the multichamber cartridge (2) according to the invention may advantageously remain in the cartridge holder (1).

However, it may also be removed for the scavenging operation or after the scavenging operation, so that it can be used again in order to continue coating.

If the method is carried out as an HVLP spray method, the atomization pressure conventionally amounts to 1.5 to 2 bar. In the case of RP guns, work is conventionally carried out at an atomization pressure of 1.5 to 3 bar.

If two components are used, one component may be, for example, what is known as a stock paint and the second component may be a hardener coordinated with the stock paint. In the stock paints, preferably hydroxyfunctional polymers, such as, for example, polyhydroxyfunctional poly (meth)acrylates, polyesterpolyols, polyetherpolyols, polyurethanepolyols or mixed polyester/polyetherpolyols are used. For example, polythiols may also be employed. In the hardener components, conventionally polyisocyanates, such as hexamethylenediisocyanate, tolylenediisocyanate, isophoronediisocyanate or diphenylmethanediisocyanate or the dimers, trimers and polymers of the abovementioned isocyanates, and/or aminoplast resins, such as, for example, melamine resins, are used. Epoxy systems, both conventional and aqueous, may likewise be employed. Of course, those systems which become reactive only when they come together with atmospheric moisture may also be used (for example, aldimines, silanes). What is true in general, however, is that stock paint and hardener have compounds with functional groups complementary to one another. That is to say, groups which react with one another after the mixing of the two components. For example, the following complementary groups may be mentioned: amine/isocyanate, hydroxy/isocyanate, thiol/isocyanate, amine/epoxy resin/isocyanate, amine/epoxy resin, epoxy resin/anhydride, amine/anhydride, anhydride/hydroxy, hydroxy/isocyanate/amine or carbodiimide/carboxyl, thiol/en, amine/cyclocarbonate, hydroxyl/cyclocarbonate, amine/hydroxyl/cyclocarbonate, oxazoline/carboxyl, silane/silane, silane/hydroxyl groups. Usually, after application, stock paint and hardener react at temperatures of 0 to 100° C., preferably 10 to 80° C., that is to say under conditions customary during repair painting.

In the method according to the invention, those stock paint/hardener combinations may also be selected which, in the conventional procedure of premixing the components before filling the paint reservoir, have potlives which are too short. Even in such systems, outstanding coatings are obtained which are distinguished by short drying and hardening times and by an outstanding appearance.

The invention claimed is:

1. A metering and mixing device, comprising:

i) a cartridge holder, comprising:

(a) a reception container for a multichamber cartridge, and (b) a compressed air connection and a connection for an application device, wherein the reception container comprises an internal tube which is arranged coaxially to walls of the cartridge holder and is equipped with static mixing elements; and ii) a multichamber cartridge for the cartridge holder, wherein the multichamber cartridge comprises:

an upper portion comprising a directional valve;

a middle portion, wherein a center of the middle portion is configured in a direction of a longitudinal axis as a tubular empty space, the tubular empty space is surrounded by at least two chambers arranged in a tubular manner and in the direction of the longitudinal axis of the cartridge, adjacent chambers are separated from one another by a common partition, and each chamber is connected to the upper portion via at least one orifice; and a lower portion which comprises a piston for each chamber, wherein the pistons close off the chambers, leak-tight, from below and are connected to one another via cutting devices arranged such that the cutting devices sever the common partition of the adjacent chambers when the pistons are displaced in the direction of the upper portion, and wherein the multichamber cartridge is arranged in the cartridge holder such that the tubular empty space of the multichamber cartridge is filled with a form fit by the internal tube of the cartridge holder, and an outer wall of the middle portion of the multichamber cartridge bears with a form fit against an inner wall of the cartridge holder.

2. The metering and mixing device of claim 1, wherein the tubular empty space and the two chambers are formed by a coaxial arrangement of an inner tube, a middle tube, and an outer tube, the inner tube surrounds the tubular empty space, an outer surface of the inner tube and an inner surface of the middle tube form a first chamber which is closed off in the direction of the lower portion by a piston and is closed off in the direction of the upper portion by an orifice to the upper portion, and an outer surface of the middle tube and an inner surface of the outer tube form a second chamber which is closed off in the direction of the lower portion by a piston and is closed off in the direction of the upper portion by an orifice to the upper portion.

3. The metering and mixing device of claim 1, wherein the tubular empty space in the multichamber cartridge serves for receiving the internal tube of the cartridge holder.

4. The metering and mixing device of claim 1, wherein the tubular empty space is surrounded by a tube, and the tube extends through the lower portion of the multichamber cartridge.

5. The metering and mixing device of claim 1, wherein the cutting devices are in the form of wedge-shape gaps.

6. The metering and mixing device of claim 1, wherein a premixing chamber is integrated in the directional valve.

7. A method for conveying, metering, and mixing of two or more components, the method comprising:

conveying, metering, and mixing the components using the metering and mixing device of claim 1.

8. A method for coating a substrate with a two-component or multicomponent coating media, the method comprising:

connecting the metering and mixing device of claim 1 to a paint spray gun, conveying the components pneumatically into the upper portion of the metering and mixing device and in the opposite direction by the static mixing elements and mixing the components to obtain a homogeneous mixture of the components, subsequently feeding the homogeneous mixture of the components to the application device, and applying the homogeneous mixture to the substrate via the application device.

9. The method of claim 8, which is interrupted once or more than once, wherein the multichamber cartridge is cleaned during the interruption, and thereafter the method resumes with the same multichamber cartridge or with another multichamber cartridge.

* * * * *